US005403071A

United States Patent [19]

Hostetler et al.

[11] Patent Number: 5,403,071

[45] Date of Patent: Apr. 4, 1995

[54] METHOD OF BRUSH SEAL TUFTING

[75] Inventors: Jeffrey D. Hostetler, Deep River, Conn.; Lawrence E. Noone, Lyman; Leo J. Lagasse, Wells, both of Me.

[73] Assignee: United Technologies Corporation, Hartford, Conn.

[21] Appl. No.: 158,099

[22] Filed: Nov. 24, 1993

[51] Int. Cl.[6] ..... A46D 1/08

[52] U.S. Cl. ..... 300/21

[58] Field of Search ..... 300/21, 2

[56] References Cited

U.S. PATENT DOCUMENTS

| | | | |
|---|---|---|---|
| 3,917,150 | 11/1975 | Ferguson et al. | 228/159 |
| 4,204,629 | 5/1980 | Bridges | 228/160 |
| 4,274,575 | 6/1981 | Flower | 228/160 |
| 4,642,867 | 2/1987 | Hough et al. | 29/423 |
| 4,678,113 | 7/1987 | Bridges et al. | 228/160 |
| 4,730,876 | 3/1988 | Werner et al. | 300/2 |
| 4,768,725 | 9/1988 | Daines et al. | 242/4 BE |
| 4,989,919 | 2/1991 | Greer | 300/10 |
| 5,165,758 | 11/1992 | Howe | 300/21 |
| 5,183,197 | 2/1993 | Howe | 228/160 |

FOREIGN PATENT DOCUMENTS

| | | | |
|---|---|---|---|
| 4041475 | 6/1992 | Germany | 300/21 |

*Primary Examiner*—John Husar

*Attorney, Agent, or Firm*—Edward L. Kochey, Jr.

[57] ABSTRACT

Wire is wound from spool 10 onto drum 15 where a multiple strand rope is formed and gripped at multiple locations. The gripped rope is cut into individual bundles, one end of each bundle being bonded to join the wires of the bundle together. The tufts may then be used to form a brush seal.

3 Claims, 2 Drawing Sheets

METHOD OF BRUSH SEAL TUFTING

TECHNICAL FIELD

The invention relates to the manufacture of metallic brush seals and in particular to a method of forming individual tufts for the fabrication of the seal.

BACKGROUND OF THE INVENTION

Brush seals can be applied to a variety of jet engine applications. Uniform wire bristle density is an important determinant of proper seal manufacture.

One method of manufacturing of brush seals uses tufts containing uniform numbers of small diameter wires. In forming these tufts it is important that the wires not be twisted in a bundle and that they be aligned properly preferably prior to cutting to length. The procedure should preferably be one with little waste of wire and no sensitivity to the length of the feed strand. There should be an inherent accurate control of the number of wires in each tuft.

SUMMARY OF THE INVENTION

A supply spool or spools containing the metal wire which is to be used for the tufts is rotatably mounted on a support. The end of the wire is secured to a winding drum which is rotated with the wire wound in a slot around the periphery of the drum, thereby forming a rope. The rotation of the drum is stopped after a predetermined number of turns, this corresponding to the number of strands in the rope.

The metal wire thread from the supply spool is then cut while the rope continues to be gripped at a plurality of locations on the drum. This gripped rope is cut into sections of predetermined length forming the tufts. These tufts are bonded at one end for use in a brush seal. Repeated cutting of the remaining rope is accomplished to complete the fabrication of the selected number of tufts.

DESCRIPTION OF THE PREFERRED EMBODIMENT

Figure 1:
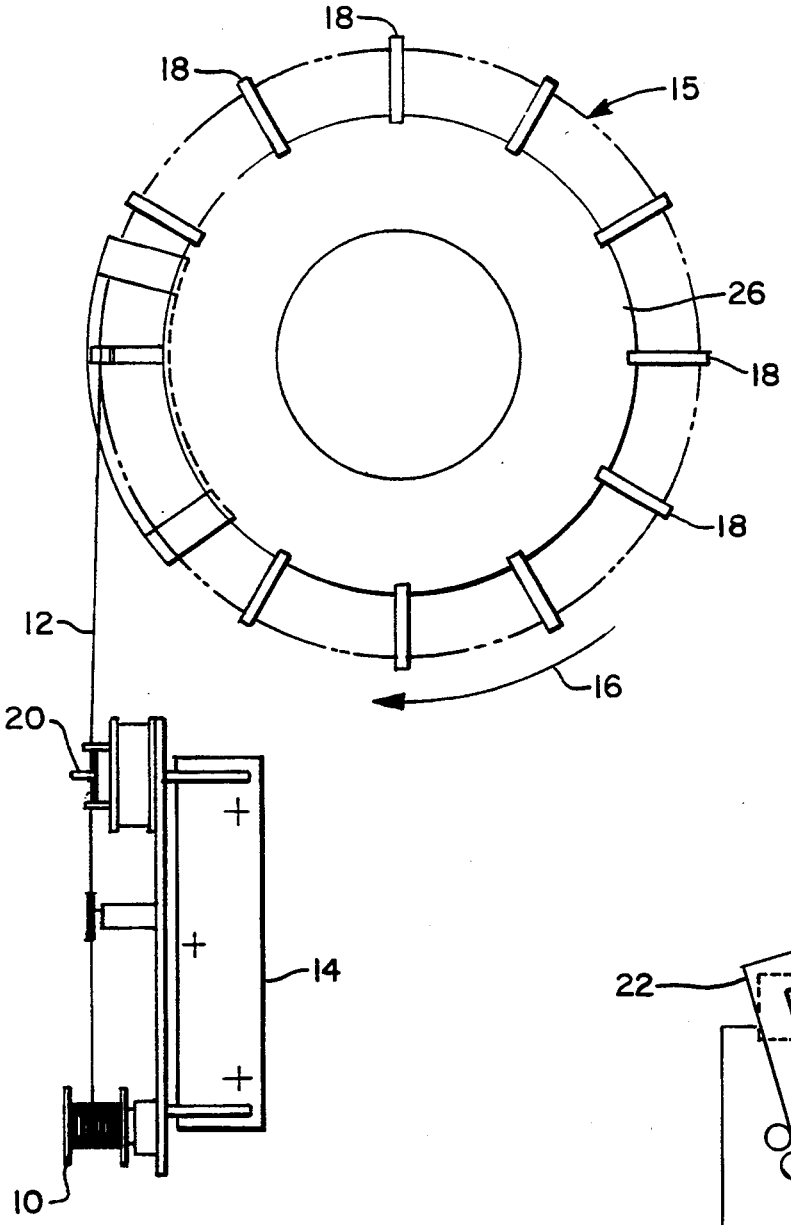
FIG. 1 is a sketch showing the winding of the wire on the drum.

Referring to FIG. 1 a spool 10 containing metallic wire 12 is rotatably mounted on a frame 14. This wire is typically of a diameter of 0.0028 inches.

One end of the wire is secured to a drum 15 which is thereafter rotated in the direction shown by arrow 16. Clamps 18 are cammed to open and close permitting the wire to fit within a slot, with the clamped then closing to retain the wire. A wire tensioner 20 is located between the spool and the drum to provide uniform tension in the wire as it is wound around the drum.

Figure 2:
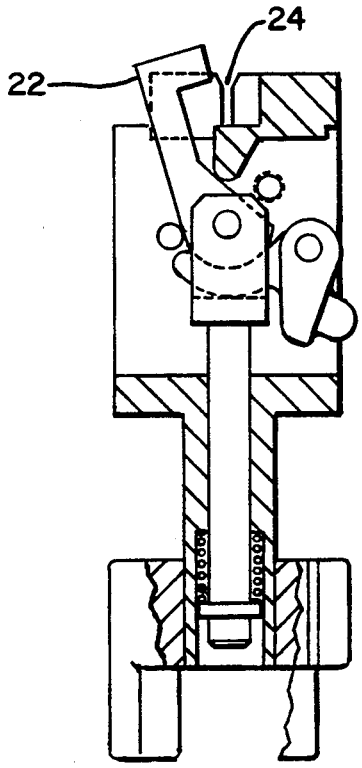
FIG. 2 is a drawing of a typical retention clamp.

As the drum 15 is rotated a rope is formed, typically between 250 and 300 wires corresponding to a like number of rotations of the drum. The wire is cut between the supply spool and the winding drum and secured to the drum. A typical clamp located on the drum 15 is illustrated in FIG. 2. The clamp 22 opens and closes over a peripherally located slot 24 to retain the rope therein while opening to admit the additional strands. Plural spools 10 may be used leading to fewer rotations for the desired number of wires. The actual number of wires may be more or less than the typical number set forth above.

The mandrel 26 of the winding drum is preferably relocated to a second, tuft cutting location. Shown in phantom in FIG. 3 is a spool 30 and a tensioner 32 indicating that it is possible to carry out both operations at the same location.

Figure 3:
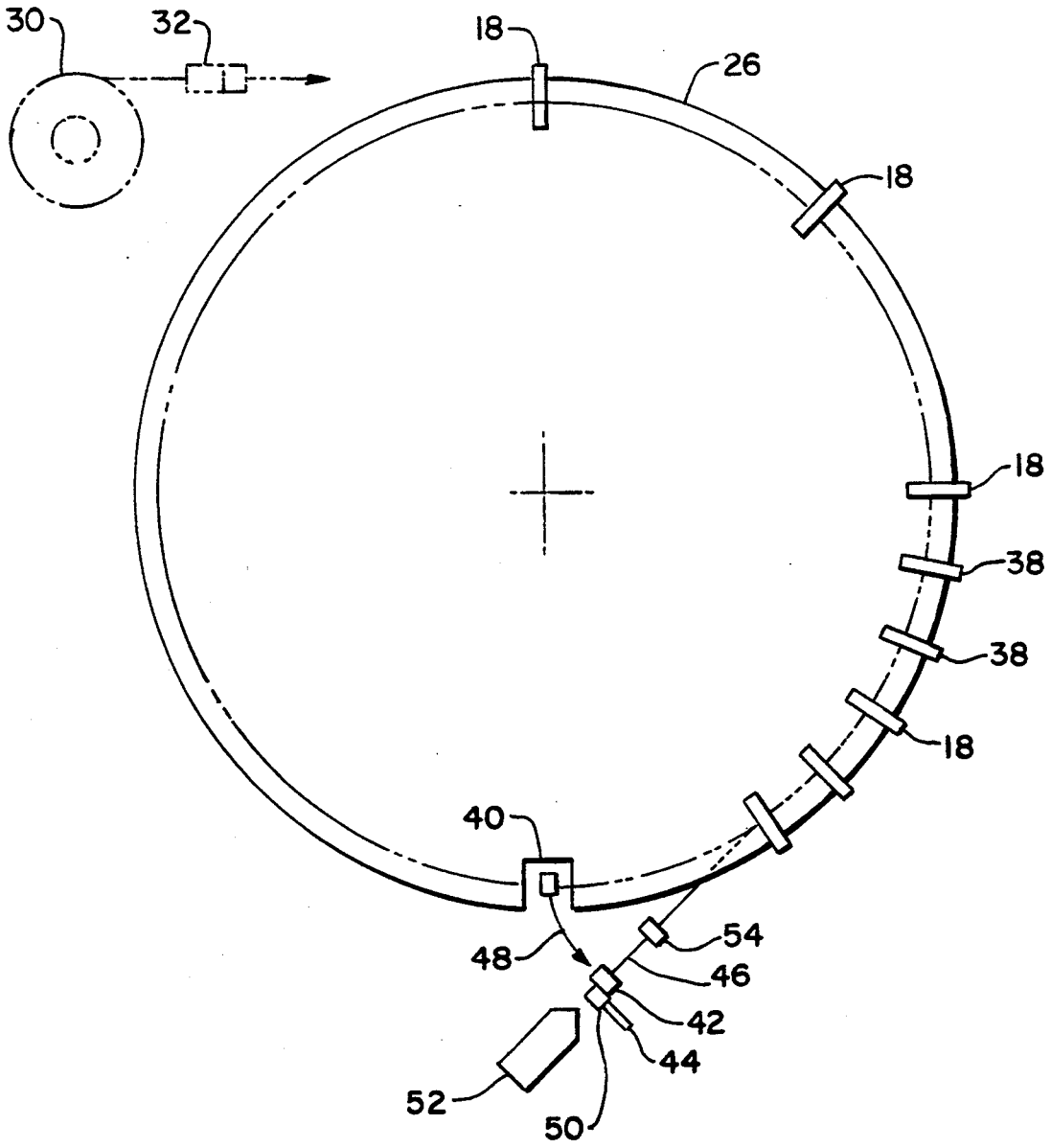
FIG. 3 is a sketch showing the cutting of the tufts, with an alternate winding arrangement shown in phantom.

Also shown in FIG. 3 are the original clamps 18 which were used to clamp the wire during winding around the drum. Additional clamps 38 are used during the cutting operation, since the relatively short tufts must be retained by a clamp until they are secured together.

Taking advantage of a notch 40 located in the winding drum a bundle of the rope is gripped by a clamp 42. The jaws of this clamp are configured to maintain the desired cross section of the wire bundle. A cutter mechanism 44 severs the bundle of wires 46. One end is retained in the groove while the other end is removed by the clamp in a path 48 to locate the severed ends of the bundle at a securing station 50. Here the ends of the wires are welded together by welding mechanism 52. Alternate forms of joining the wires together such as shrink tubing glue or wax could be used.

An indexing clamp arrangement 54 advances the wire bundle one tuft length with the drum rotating accordingly. The earlier secured and welded tuft is then severed from the end of the bundle.

The newly cut end is positioned at the securing station and the process is repeated until the entire wire bundle has been used. Typically the drum will be about 29 inches in diameter with the total of 60 clamps being used. Six to twelve of these clamps will be used and activated on the first fixture during the winding of the wire around the drum to form the rope. The remainder are required in the cutting of the tufts which with the described drum would be approximately 60 tufts each one and a half inches long.

After being so formed these tufts are then used for the fabrication of a brush seal. This machine may be easily modified for cutting tufts of different lengths and of different numbers of wires per tuft.

We claim:

1. A method of forming brush seals comprising:

mounting a supply spool of metal wire thread rotatably on a support;

rotating a winding drum, and winding wire from said spool onto said drum, forming a rope;

stopping the rotation of said drum after a predetermined number of turns corresponding to the number of strands in said rope;

cutting said metal wire thread between said supply spool and said winding drum;

gripping said rope at a plurality of locations forming a gripped rope;

cutting a portion of said gripped rope to a predetermined length forming a tuft;

bonding one end of the wires of said tuft to each other forming a bonded tuft for use in a brush seal; and repeatedly cutting a portion of the remainder of said gripped rope and bonding one end of the wires of each tuft so formed.

2. A method of claim 1 wherein the step of winding wire from said spool onto said drum comprises:

winding the wire into a slot around the periphery of said drum.

3. A method of claim 1 wherein the step of bonding one end of the wires of said tuft comprises:

welding the ends of said wires to each other.

* * * * *